US010577789B2

(12) United States Patent
Kelly et al.

(10) Patent No.: US 10,577,789 B2
(45) Date of Patent: Mar. 3, 2020

(54) ANCHOR SYSTEM FOR WALL PANELS AND FORMWORK

(71) Applicant: Meadow Burke, LLC, Tampa, FL (US)

(72) Inventors: David Kelly, Sacramento, CA (US); Michael Recker, Palmetto, FL (US); Ronald G. Naumann, Valrico, FL (US)

(73) Assignee: Meadow Burke, LLC, Tampa, FL (US)

( * ) Notice: Subject to any disclaimer, the term of this patent is extended or adjusted under 35 U.S.C. 154(b) by 0 days.

(21) Appl. No.: 16/025,672

(22) Filed: Jul. 2, 2018

(65) Prior Publication Data

US 2019/0010694 A1 Jan. 10, 2019

Related U.S. Application Data

(60) Provisional application No. 62/551,603, filed on Aug. 29, 2017, provisional application No. 62/529,998, filed on Jul. 7, 2017.

(51) Int. Cl.
*E04B 1/41* (2006.01)
*E04B 1/04* (2006.01)

(52) U.S. Cl.
CPC ..... *E04B 1/41* (2013.01); *E04B 1/043* (2013.01); *E04B 2103/02* (2013.01)

(58) Field of Classification Search
CPC ..... E04B 1/41; E04B 1/043; E04B 2103/02
USPC ..... 52/698
See application file for complete search history.

(56) References Cited

U.S. PATENT DOCUMENTS 1,341,585 A * 5/1920 Pool ..... E04B 1/4135 52/699
1,664,827 A * 4/1928 Nicholay ..... E04B 1/4135 52/223.13
1,922,479 A * 8/1933 Pliny ..... E04B 1/4128 52/701
1,933,536 A * 11/1933 Awbrey ..... E04B 1/4135 52/708
4,665,672 A * 5/1987 Commins ..... E04B 1/0007 403/190
5,609,005 A * 3/1997 Schierloh ..... E04B 1/355 249/83
5,619,834 A * 4/1997 Chen ..... E04F 13/0855 52/126.1
5,846,018 A * 12/1998 Frobosilo ..... E04B 2/96 403/403

(Continued)

FOREIGN PATENT DOCUMENTS

CN 207033470 U * 2/2018
DE 2412666 A1 * 9/1975 ..... E04B 1/043
KR 20020016480 A * 3/2002

*Primary Examiner* — Jeanette E Chapman
(74) *Attorney, Agent, or Firm* — Sheridan Ross PC

(57) ABSTRACT

An improved anchor for provision within a concrete panel or other structural member is provided. The anchor is operable to connect a wall panel or similar concrete to a footer member or other structural component. The anchor assembly comprises a void and a removable portion that allows for a portion of the anchor assembly to be pivoted from a first position to a second position, wherein the first position comprises a stowed position within the wall and the second position comprises a position operable to securing or connecting structural members.

20 Claims, 11 Drawing Sheets

(56) References Cited

U.S. PATENT DOCUMENTS

| | | | | |
|---|---|---|---|---|
| 6,494,639 | B1 * | 12/2002 | Friend | E04B 1/043<br>403/205 |
| 8,448,397 | B2 * | 5/2013 | Tincher | E04B 1/4114<br>249/83 |
| 8,955,285 | B2 * | 2/2015 | Fournier | E04B 1/4107<br>52/463 |
| 9,045,892 | B2 * | 6/2015 | Smith | E04B 1/003 |
| 9,732,518 | B2 * | 8/2017 | Croasdale | E04B 2/562 |
| 9,816,239 | B1 * | 11/2017 | Morris | E02B 3/023 |

* cited by examiner

ANCHOR SYSTEM FOR WALL PANELS AND FORMWORK

This U.S. Non-Provisional Patent Application claims the benefit of priority from U.S. Provisional Patent Application Ser. No. 62/529,998, filed Jul. 7, 2017, and U.S. Provisional Patent Application Ser. No. 62/551,603, filed Aug. 29, 2017, the entire disclosures of which are hereby incorporated by reference.

FIELD

The present disclosure generally relates to lifting inserts and anchors for precast or preformed concrete panels. More specifically, the present disclosure relates to lifting inserts for embedment in a precast concrete structure and that comprise a lifting anchor and a moveable component for securing the insert and associated panel to an additional component.

BACKGROUND

Various existing devices and methods are provided for securing wall panels to foundation elements. In applications comprising wooden framework, lumber is typically secured to concrete with a threaded bolt and a nut at various locations. However, in applications involving precast concrete wall panels including "tilt-up" wall panels, the step of securing a wall panel to a foundation element is more complicated. Existing anchors and securing devices for such applications are known to either provide inadequate structural integrity or tend to damage the precast concrete. Damage to the precast concrete is known to occur when applying or installing an anchor to a precast or prefabricated wall panel, and/or where an anchor is provided within the precast panel and subject to impact and damage during movement and positioning of the wall panel.

SUMMARY

Accordingly, there has been a long-felt but unmet need to provide an anchor system with an element that is moveable between a first position and a second position, and wherein the first position comprises a stowed position of the element and the second position comprises an anchoring positioning. The anchoring position comprises a position wherein the anchor system is operable to be secured to a structural element such as a footer, wall panel, or formwork.

In various embodiments, the present disclosure provides an anchor system that is operable for use with and particularly well adapted for connecting wall panels and formwork such as foundation elements. For example, in some embodiments, an anchor system is provided that is operable to be embedded in a precast concrete wall panel and wherein at least a portion of the anchor system is operable to extend outwardly from the wall panel and be selectively secured to a foundation wall or similar structural element. It should be recognized, however, that embodiments of the present disclosure are not limited to use or interconnection with any particular element or feature. Inventive and patentable aspects of embodiments of the present disclosure reside in structural features of the anchors and anchor elements shown and described herein, regardless of intended use or application.

In one embodiment, an anchor is provided comprising a plate portion having a first end and second end, the first end comprising a free end operable to be disposed within a volume of concrete structure, and a bent portion provided proximal to the second end, wherein the bent portion comprises a deviation from the plate portion, and wherein the bent portion comprises an upper surface and a lower surface. A projection is provided on at least one of the upper surface and the lower surface. A link member is rotatably secured to the projection, and the link member comprises a first aperture for receiving the projection and a second aperture for receiving an elongate fastener.

In various embodiments, methods of forming and connecting structures are provided. In one embodiment, a method of securing structural components is provided, the method comprising providing the anchor assembly as shown and described herein within a precast concrete wall panel, positioning the precast concrete wall panel in a desired position proximal to a foundation member, removing a cap of a void former provided in the precast concrete wall panel, rotating the link member from a first position within the void former to a second position wherein the link member extends outwardly from the precast concrete wall panel, drilling a hole in the foundation member, providing a threaded bolt through the second aperture of the link member and through at least a portion of the foundation member to secure the link member, the anchor, and the precast concrete wall panel to the foundation member.

In some embodiments, it is contemplated that a fastener including a bolt of a screw is provided in a foundation element, and a link of the present disclosure is operable to extend outwardly from a wall panel to be secured to a preexisting or pre-installed fastener. For example, a link of the present disclosure may be modified to comprise a peripheral opening or cut out that can secure or clip to an existing fastener.

In some embodiments, a void former is provided to enable the creation of a void in foundation formwork or other concrete structure(s). In certain embodiments, a one piece former is provided with a wrap-around enclosure and two molded hinges. It is contemplated that the hinges are also operable to serve as "tear" points to remove a portion of the void former after pouring of concrete (for example). In preferred embodiments, void formers of the present disclosure comprise thin, strong, flexible plastic members with one or more seals or seams that resist penetration of concrete around the void and various associated components. Molded-in "snap" retainers are provided to hold a cover in place. The cover(s) of void formers according to the present disclosure are arranged to be removed by lifting an end of the cover. Prying tools and/or pliers may be used to tear a cover off at a hinge or other break or score point. The cover(s) provide an enclosure that keeps a link area free of concrete and allows for the pivoting of various links and components (after removal of the cover(s)) as shown and described herein.

In various embodiments, each void former of the present disclosure comprises an ear member at one or more ends of the void former to provide stability to the void former, particularly prior to pouring of surround concrete. The ear member(s) also provide for an attachment point of the void former to the form work. In some embodiments, the ear(s) comprise ribbing to allow for threaded engagement of attachment screws and/or other fasteners.

Void formers of the present disclosure are contemplated as comprising various plastics and other materials. In some embodiments, void formers comprise polyolefin that provides adequate strength and resistance to cracking and breaking under load or impact but is still light-weight and affordable. Anchors and voids of some embodiments of the present disclosure are contemplated as being packaged and shipped in an assembled or semi-assembled state for ease of shipping and use. The voids are contemplated as comprising various colors to indicate various information or intended uses and/or accommodate user-preference. In some embodiments, radii of the corners of void formers are provided to increase the strength and crack-resistance of the void formers.

The Summary is neither intended nor should it be construed as being representative of the full extent and scope of the present disclosure. The present disclosure is set forth in various levels of detail in the Summary as well as in the attached drawings and the Detailed Description and no limitation as to the scope of the present disclosure is intended by either the inclusion or non-inclusion of elements, components, etc. in this Summary. Additional aspects of the present disclosure will become more readily apparent from the Detailed Description, particularly when taken together with the drawings.

BRIEF DESCRIPTION OF THE DRAWINGS

The accompanying drawings, which are incorporated in and constitute a part of the specification, illustrate embodiments of the disclosure and together with the general description of the disclosure given above and the detailed description of the drawings given below, serve to explain the principles of the disclosure.

It should be understood that the drawings are not necessarily to scale. In certain instances, details that are not necessary for an understanding of the disclosure or that render other details difficult to perceive may have been omitted. It should be understood, of course, that the disclosure is not necessarily limited to the particular embodiments illustrated herein.

DETAILED DESCRIPTION

Figure 1B:
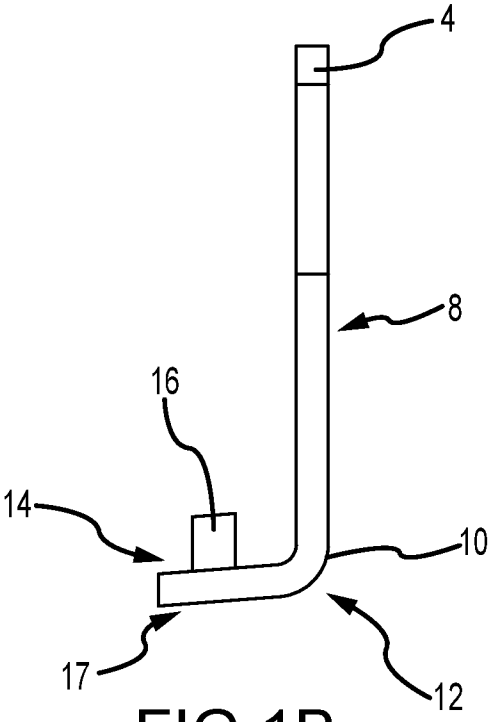
FIG. 1B is a side elevation view of an anchor according to one embodiment of the present disclosure.
Figure 1A:
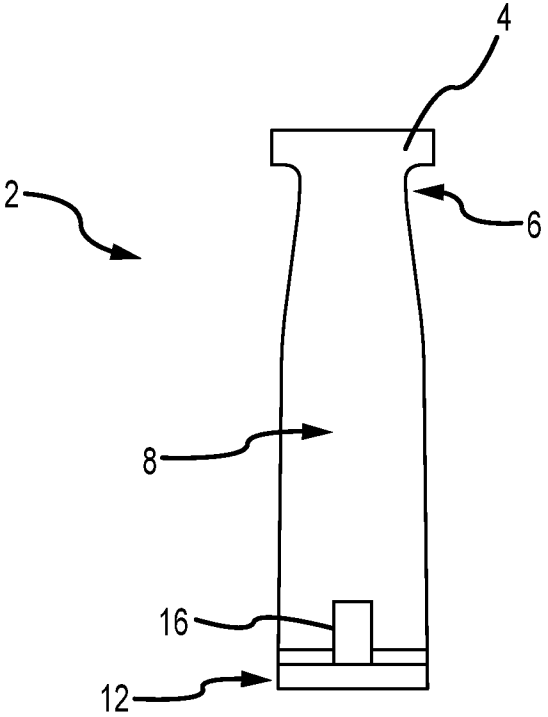
FIG. 1A is a front elevation view of an anchor according to one embodiment of the present disclosure.

FIG. 1A is a front elevation view of an anchor 2 according to one embodiment of the present disclosure. As shown, the anchor 2 comprises a device that is operable to be cast within and/or disposed within a concrete member, such as a wall panel. The anchor 2 comprises a foot 4 and a necked portion 6 at one end of the anchor. A plate portion 8 extends away from the foot 4 and necked portion 6 and transitions to a curved portion 10. The curved portion 10 generally comprise a bend or deflection of the plate portion 8 to an angled portion 12. The angled portion 12 is preferably provided at an angle of between about 70 and 100 degrees relative to a plane that extends through the plate portion 8. In one embodiment, the angled portion 12 is provided at an angle of about 84 degrees relative to the plate portion. The angled portion 12 comprises an upper portion 14 and a lower portion 17. The upper portion 14 comprises a stud member 16. In some embodiments, the stud member 16 comprises a welded stud that extends from the upper portion 14. In alternative embodiments, the entire anchor 2, including the stud 16 is a single molded or cast piece. Although not shown in FIG. 1A, a projection or stud member may extend from either or both of the upper and lower portions of the angled portion 12.

FIG. 1B is a side elevation view of the anchor 2 shown in FIG. 1A. The stud member 16 is contemplated in one embodiment as comprising a stud with a diameter of approximately 0.75 inches and a height of approximately 1.0 inch. It is contemplated, in some embodiments, that the diameter is between approximately 0.5 inches and 2.0 inches and the height is between approximately 0.5 inches and 6.0 inches.

Figure 2B:
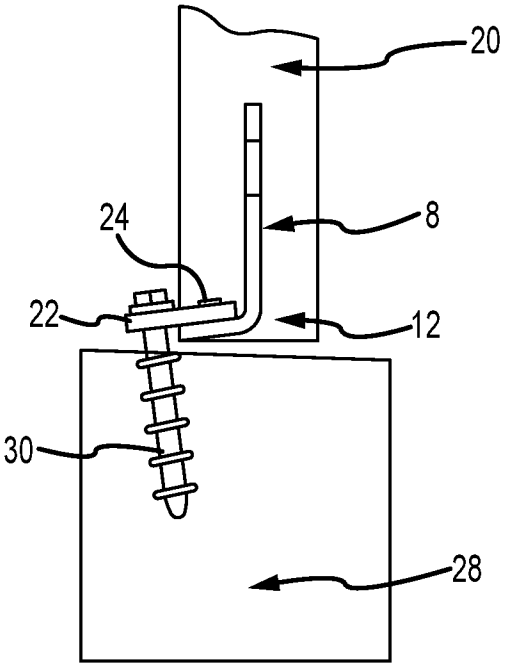
FIG. 2B is a side elevation view of an anchor assembly provided in combination with a structural assembly.
Figure 2A:
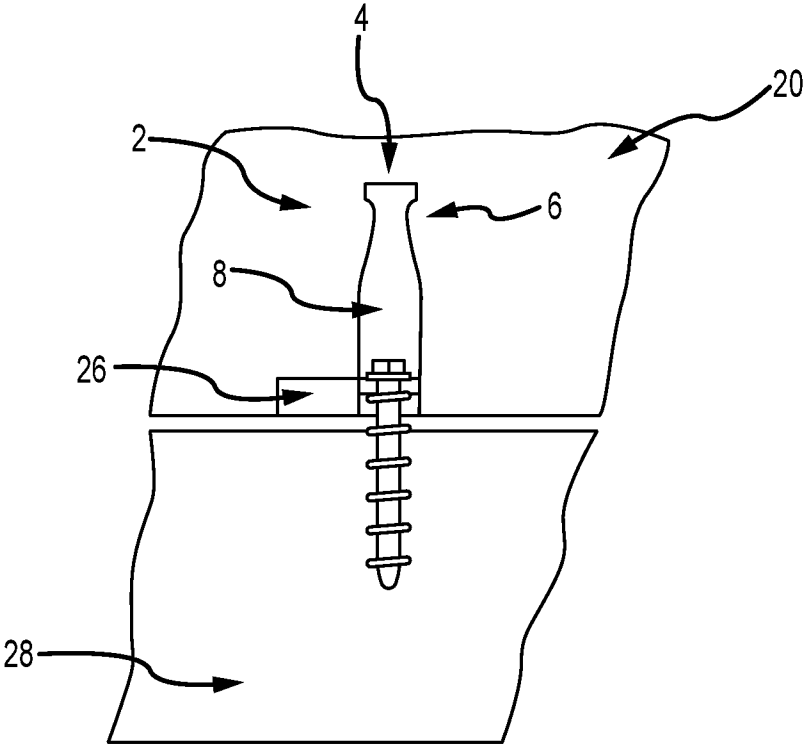
FIG. 2A is a front elevation view of an anchor assembly provided in combination with a structural assembly.

FIGS. 2A and 2B are front and side elevation views of an anchor assembly including an anchor 2 according to one embodiment of the present disclosure, and wherein the anchor assembly is provided within a structure to secure at least two components of the structure. Specifically, the anchor 2 is at least partially provided within a concrete wall panel 20. A link 22 is provided in combination with the anchor 2. In various embodiments, the link 22 is provided on the stud member 16. The link 22 is secured to the anchor 2 by placing the stud member 16 through a hole in the link 22 and securing the link 22 by providing a washer or flange on an upper portion of the stud member 16. In certain embodiments, a welded washer 24 is provided to secure the link 22 on the stud member (not shown in FIGS. 2A-2B, but shown as 16 in FIG. 1B) and allow the link 22 to rotate on the stud member. Alternative securing means are also contemplated. For example, a threaded nut is contemplated as being provided on the upper portion of the stud member 16. In additional embodiments, a flange is formed or the stud member 16 is otherwise deformed such that the upper portion of the stud member 16 is larger than an aperture in the link 22. Preferably, however, a welded washer is provided to render the anchor assembly structurally capable of securing the wall panel 20 to an adjacent component as shown and described herein. In various embodiments, the link is contemplated as being provided as a separate, selectively-attachable component of the system.

As shown in FIG. 2A, the concrete wall panel 20 in one embodiment is provided with a void 26 during formation of the wall panel 20. The void 26 provides a stowage compartment for the link 22, which is rotatable about the stud member 16. Accordingly, the link 22 may be stowed within a portion of the wall panel 20 for transportation and handling of the wall panel and may also be selectively deployed to a securing position. The securing position is shown in FIG. 2B, wherein the link 22 is shown as being extended from the wall panel. The wall panel 20 is secured to an adjacent component, such as a foundation footer 28. A self-threading brace bolt 30 is provided through an aperture in the link 22 and into the footer 28 to secure the anchor 2 and the wall panel 20 to the footer 28. Although FIG. 2 provides an anchor and bolt secured to a foundation footer, it is contemplated that the anchor assembly and bolt may be secured to and communicate with a variety of structural components including, for example, soil foundations, concrete footers, additional wall members, and various similar substrates or base members.

Figure 3:
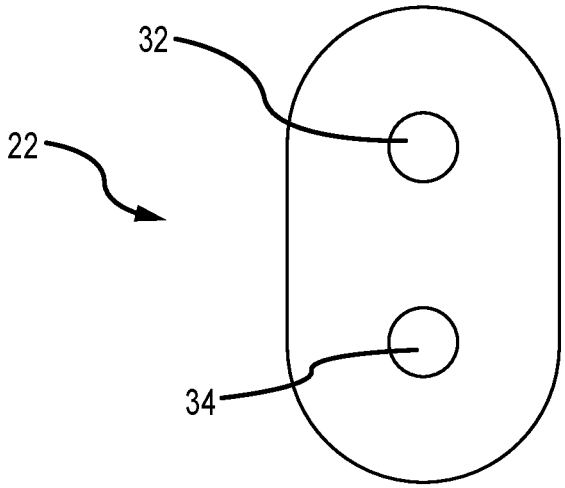
FIG. 3 is a top plan view of a component of an anchor assembly according to one embodiment of the present disclosure.

FIG. 3 is a top plan view of a link 22 according to one embodiment of the present disclosure. As shown, the link 22 comprises first and second apertures 32, 34. One aperture is provided to receive the stud member 16 of the anchor 2, and the other aperture is provided to receive a bolt 30 as shown in FIG. 2B, for example. In the embodiment of FIG. 3, the link is provided as a symmetrical component with apertures that can be reversed, and such that it is generally not possible to install the link in an incorrect position. The link 22 of FIG. 3 is shown as having certain dimensions. It will be expressly recognized, however, that the dimensions are provided to illustrate one particular embodiment only, and that variations to the size, shape and proportions of the link are contemplated as being within the scope and spirit of the present invention.

Figure 4A:
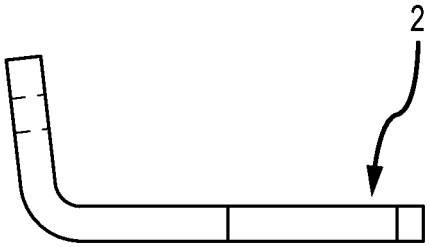
FIG. 4A is a side elevation view of an anchor according to one embodiment of the present disclosure.
Figure 4B:
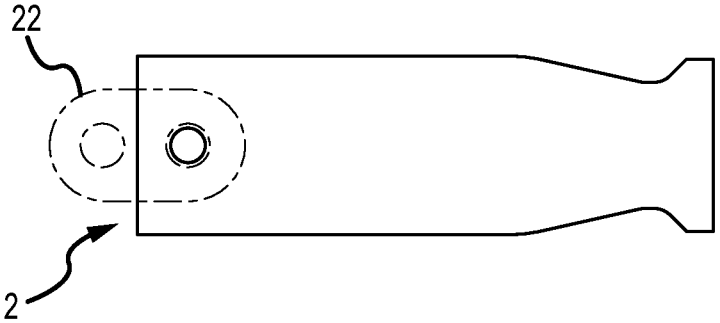
FIG. 4B is a plan view of an anchor according to one embodiment of the present disclosure.

FIGS. 4A-4B depict an anchor 2 according to one embodiment of the present disclosure. As shown, the anchor 2 is shown as comprising various dimensions. These dimensions (provided in inches) are provided to illustrate one particular embodiment only, and that variations to the size, shape and proportions of the anchor are contemplated as being within the scope and spirit of the present invention.

Figure 5C:
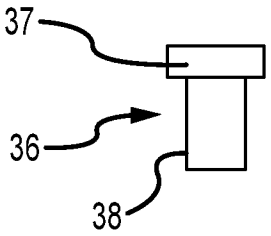
FIG. 5C is an elevation view of a component of an anchor assembly according to one embodiment of the present disclosure.
Figure 5A:
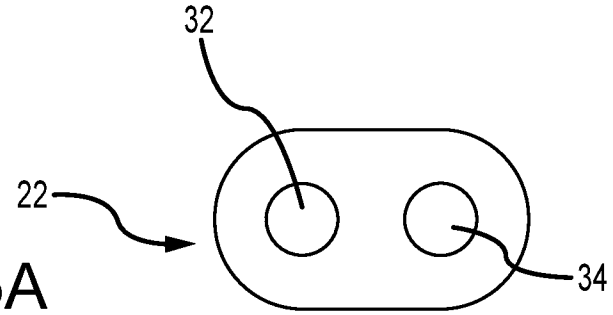
FIG. 5A is a top plan view of a component of an anchor assembly according to one embodiment of the present disclosure.
Figure 5B:
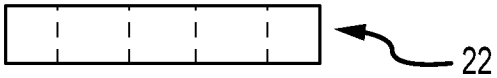
FIG. 5B is a side elevation view of a component of an anchor assembly according to one embodiment of the present disclosure.

FIGS. 5A-5B provide a link 22 comprising first and second apertures 32, 34. The link is provided with various dimensions. These dimensions (provided in inches) are provided to illustrate one particular embodiment only, and that variations to the size, shape and proportions of the link are contemplated as being within the scope and spirit of the present invention. FIG. 5C illustrates a pin 36 that is operable to secure a link 22 to an anchor 2 according to at least one embodiment of the present disclosure and as shown in more detail in FIG. 6.

Figure 6:
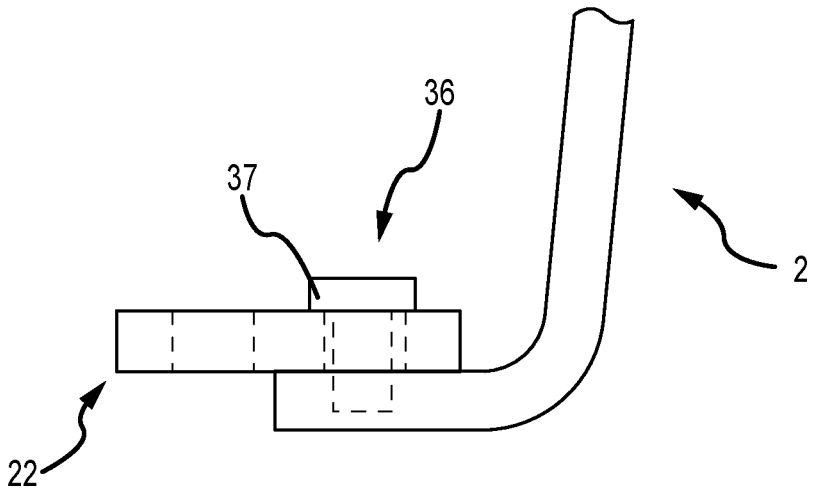
FIG. 6 is a detailed elevation view of an anchor assembly according to one embodiment of the present disclosure.

FIG. 6 is a side elevation view of an anchor 2 with a link 22 secured thereto via a pin 36. The pin 36 comprises an expanded head portion 37 and an elongate body portion 38. When assembled, the elongate body portion 36 extends through an aperture of the link 22 and into a portion of the anchor 2. The expanded head 37 is operable to secure the link 22 to the anchor in a manner in which the link 22 is rotatable about the pin 36. The pin may be secured to the anchor 2 in the position shown in FIG. 6 by various means and methods including, for example, press-fitting, welding, and threading. The assembly of FIG. 6 provided a device wherein the link is rotatably secured to the anchor 2 such that the link can be stowed within a void in a wall panel (for example) in which the anchor is embedded, and wherein the link 22 can be rotated out of the void to a position wherein the link 22 is operable to receive a bolt or similar fastener and secure the anchor 2 and related components to an additional feature, such as foundation wall, concrete pad, ground material, etc.

Figure 7:
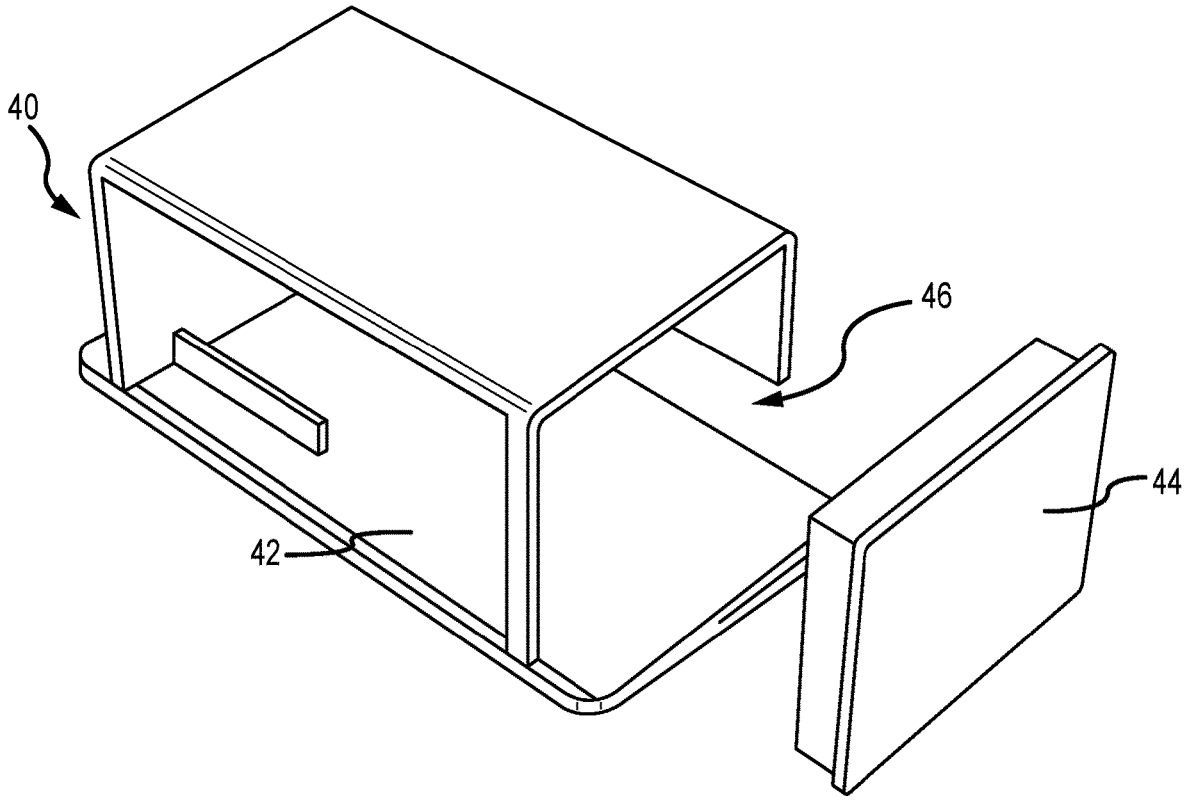
FIG. 7 is a perspective view of a void former according to one embodiment of the present disclosure.

FIG. 7 is a perspective view of a void former 40 according to one embodiment of the present disclosure and wherein the void former is operable to provide a void in a precast concrete member. The void former 40 is operable to create a void in a wall panel that receives and houses a link of the present disclosure in a first position. The link is generally hidden and protected in this first position to reduce or eliminate risks of the link and surrounding concrete being damaged prior to positioning the wall panel in a final position. The void former 40 comprises a main body portion 42 and a removable cap 44. The main body portion 42 comprises a slot or cut-out 46 to create a point of ingress and egress for a link of the present disclosure. The void former 40 is provided in a desired position prior to forming a precast wall panel, such that the finished wall panel comprises the appropriate void.

Figure 8C:
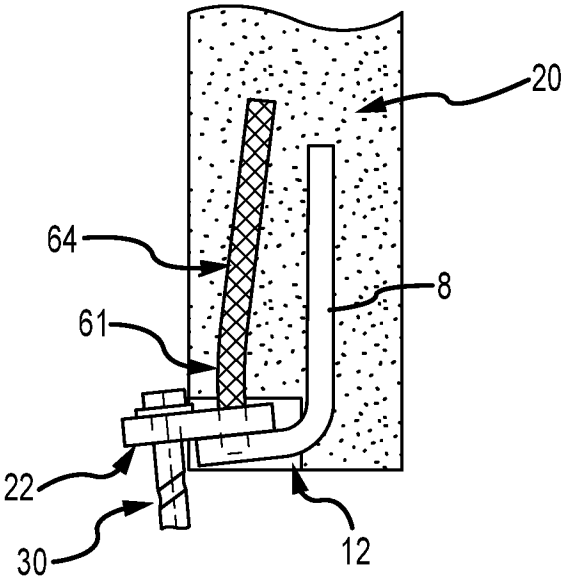
FIG. 8C is a side elevation view of an anchor system according to one embodiment of the present disclosure.
Figure 8B:
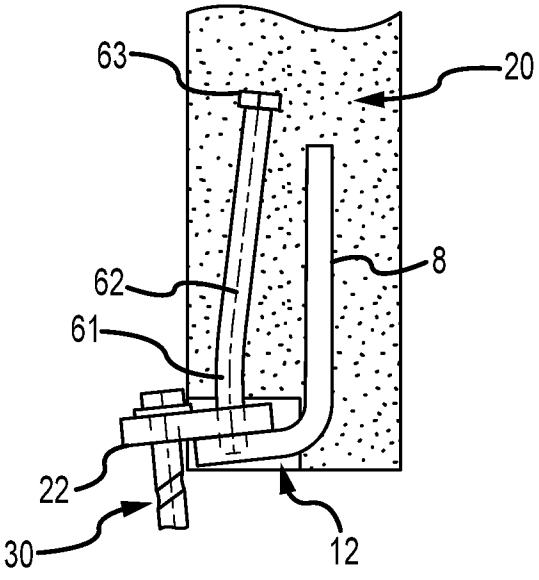
FIG. 8B is a side elevation view of an anchor system according to one embodiment of the present disclosure.
Figure 8A:
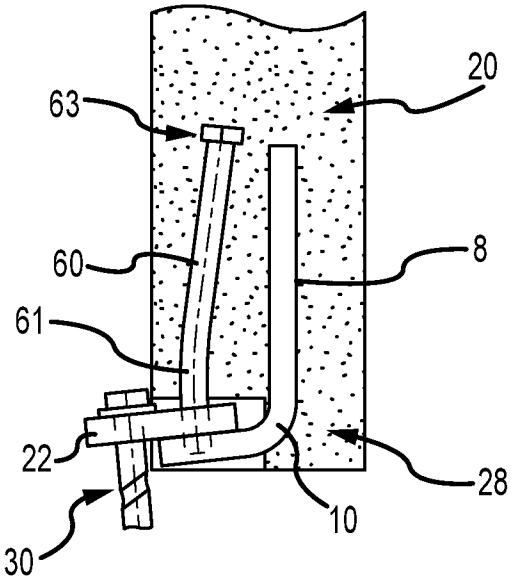
FIG. 8A is a side elevation view of an anchor system according to one embodiment of the present disclosure.

FIG. 8A is a cross-sectional side elevation view of an anchor assembly according to one embodiment of the present disclosure. As shown in FIG. 8A, a link 22 is provided in rotatable communication with an elongate reinforcing member 60. In the embodiment of FIG. 8A, the elongate reinforcing member 60 comprises a stud, and preferably comprises a stud with a bend or angle provided along the length of the member 60. The elongate reinforcing member provides a point of rotation about which the link 22 is rotatable and further increases the strength and load capacity of the anchor assembly. The reinforcing member 60 provides additional support and strength to the assembly and reduces the risk that the curved portion 10 of the anchor will deform substantially from the position shown in FIG. 8A. In some embodiments, the elongate reinforcing member 60 provides additional strength to the link 22 and reduces the risk that the link 22 is deformed when the system is placed under stress.

FIG. 8B is a cross-sectional side elevation view of an anchor assembly according to one embodiment of the present disclosure. The embodiment of FIG. 8B comprises various structural features provided in the embodiment of FIG. 8A. The elongate reinforcing member 62 of FIG. 8B, however, comprises a greater length than the member 60 of FIG. 8A. FIG. 8B is provided to illustrate that embodiments of the present disclosure are not limited to elongate reinforcing members of any particular length. The embodiments of FIGS. 8A-8B depict elongate reinforcing members comprising an elongate portion with a head 63 on one end.

FIG. 8C is a cross-sectional side elevation view of an anchor assembly according to one embodiment of the present disclosure. The anchor assembly of FIG. 8C comprises an elongate reinforcing member 64 in the form of a segment of rebar. Specifically, a 10-inch length of #6 rebar is contemplated as being provided as an elongate reinforcing member 64 about which the link 22 is rotatable and which provides structural stability to the anchor assembly similar to the embodiments of FIGS. 8A and 8B.

The embodiments of FIGS. 8A-8C provide for elongate reinforcing members of various construction which are designed to replace a pin or stud as shown and described in other embodiments (see 36 of FIG. 6, for example). In further embodiments, however, it is contemplated that a pin is provided as a rotation axis for a link and an elongate reinforcing member is further provided to increase the structural stiffness and strength of the system. For example, a pin and an elongate reinforcing member are contemplated as being provided in communication with an anchor and as extending from either or both of the angled portion 12 and the plate portion 8.

Figure 9:
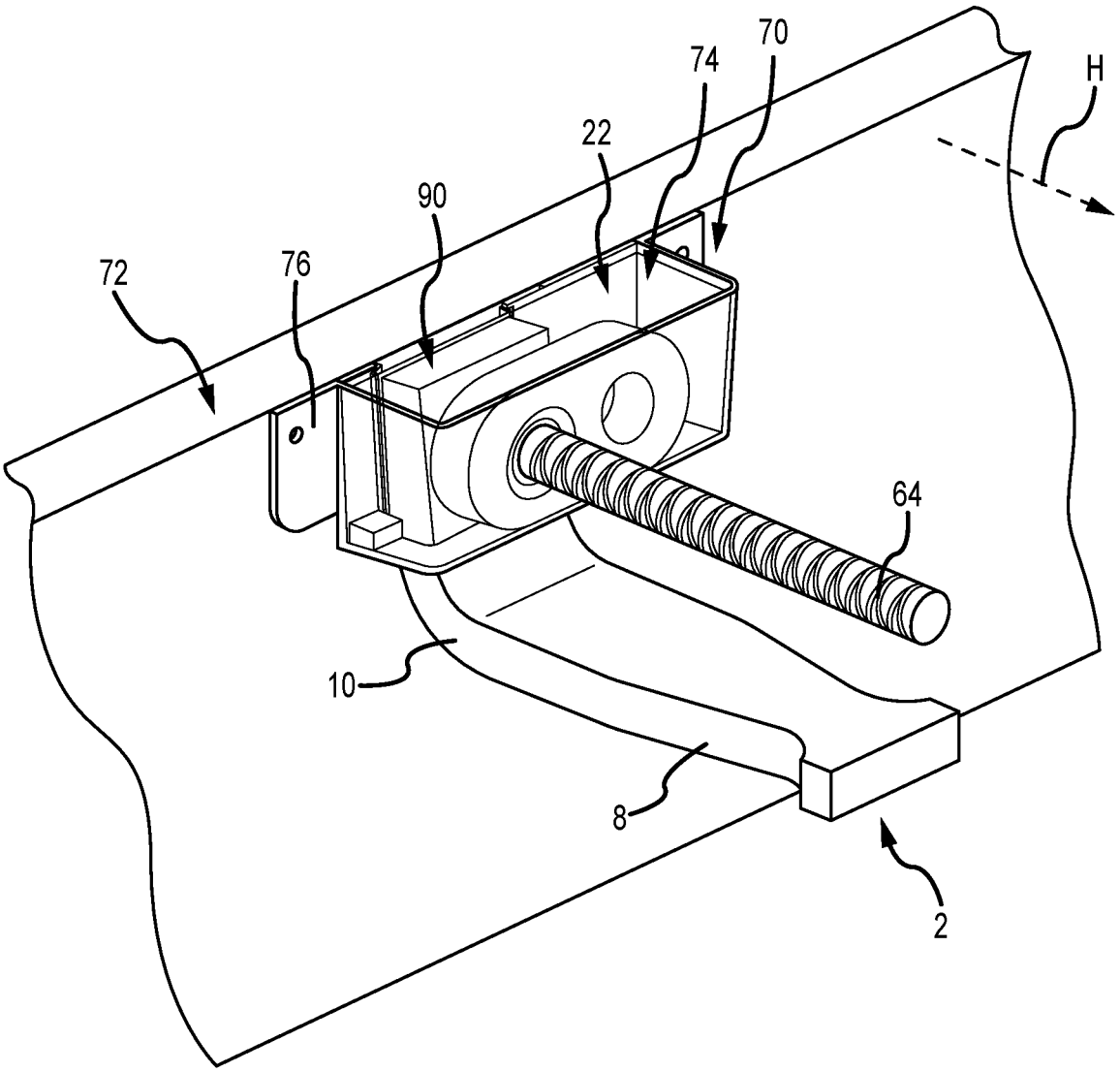
FIG. 9 is a perspective view of an anchor system with a void former according to one embodiment of the present disclosure.

FIG. 9 is a perspective view of an anchor assembly 2 and a void former 70 provided in an assembled state and in combination with a section of formwork 72. As shown in FIG. 9, the system 2 is prepared for concrete and is ready to receive a quantity of concrete. An anchor member with an elongate reinforcing member 64 is illustrated and a void former 70 is provided. The void former 70 is operable to prevent penetration of concrete to certain portions of the system and to create a void that surrounds at least the link 22 after pouring of concrete.

Various components of the system 2 are operable to be cast within a volume of concrete. However, as will be recognized by one of ordinary skill in the art, the link 22 is to remain rotatable about the reinforcing member 64 (or similar) even after pouring of concrete. The void former 70 is thus provided to create a void and enable movement of the link 22. The void former 70 comprises ears 76 that are arranged to be provided flush with formwork 72 or a similar structure. In some embodiments, the ears 76 are operable to receive one or more fasteners and secure the void to the formwork in a desired position. The void former 70 further comprises a removable panel 74 that is operable to and arranged to prevent ingress of concrete to an internal volume of the void former 70. The panel 74 is further operable to and arranged to be removed after concrete is poured. In various embodiments and methods of use, a cured volume of concrete will extend orthogonally to a surface of the formwork 72 and in a direction H. Thus, various components of the system 2 are encased in concrete and the panel 74 is provided flush or approximately flush with a planar surface of a formed concrete structure. The panel 74 is removable to enable the link 22 to rotate outwardly from the formed concrete structure as shown and described herein.

Figure 10:
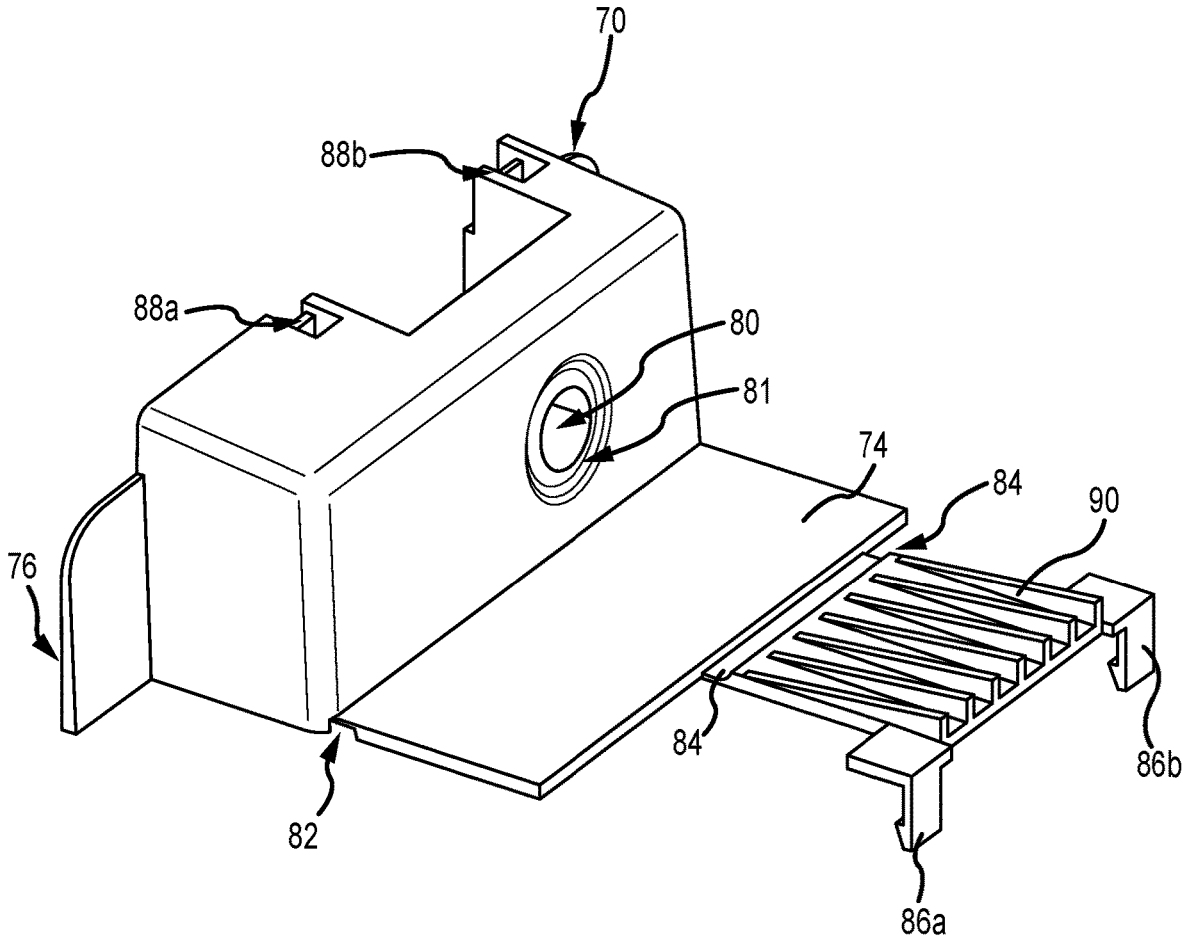
FIG. 10 is a perspective view of a void former according to one embodiment of the preset disclosure.

FIG. 10 is a perspective view of a void former 70 shown in isolation for illustrative purposes. As shown, the void former 70 comprises a generally rectilinear cube. A panel 74 is provided and is hingedly connected to a remainder of the void former at a first hinge 82. A closure member 90 is provided that is hinged to the panel 74 at a second hinge 84. The closure member 90 comprises first and second clasps 86*a*, 86*b*, which are operable to communicate and connect with first and second latch members 88*a*, 88*b*, respectively. An aperture 80 is provided through which an elongate reinforcing member 64 can be received. The aperture 80 preferably comprises a ribbed circumference 81 that provides an enhanced seal around an elongate reinforcing member that is to be provided through the aperture 80. As opposed to a simple circular aperture, embodiments of the present disclosure contemplate the provision of ribs 81 in a plastic void former to create elasticity that enables an interior circumference of the aperture 80 to conform to the reinforcing member (e.g. rebar) and create a seal that prevents ingress of concrete.

In embodiments that do not comprise an elongate reinforcing member, the aperture 80 is contemplated as being provided with a plug or seal. The void former 70 of FIG. 101 comprises single injection-molded piece that provides ease of assembly.

Figure 11:
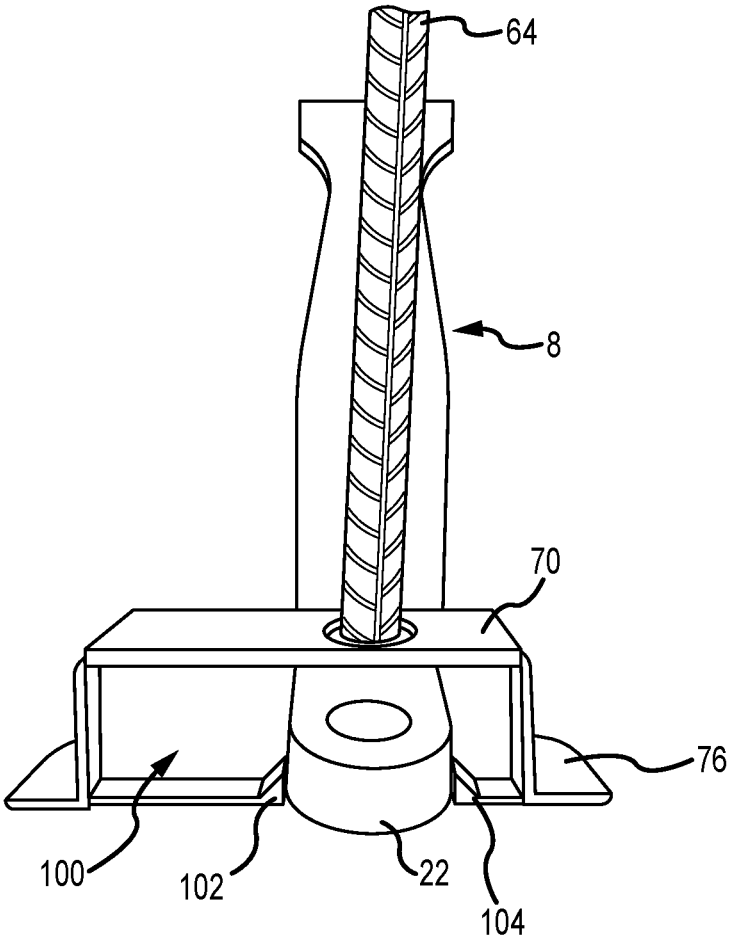
FIG. 11 is a perspective view of an anchor system with a void former according to one embodiment of the present disclosure.

FIG. 11 is a front elevation view of an anchor assembly and void former provided in isolation and in an assembled state for illustration purposes. As shown, the void former 70 is provided without the panel 74 shown and described herein. Removal of the panel provides access to an interior void 100 of the void former, even after pouring and curing of concrete. The open void former 70 of FIG. 11 thus allows for rotation of a link 22 to the position shown in FIG. 11. The link 22 of FIG. 11 is prepared for receiving a bolt or fastener to secure the anchor assembly to a formwork, ground surface, or a substrate. Fasteners for use with embodiments of the present disclosure include, but are not limited to, threaded bolts, soil nails, nails, rebar members, and stakes.

As shown in FIG. 11, the void former 70 comprises locking members 102, 104 for securing the link 22 in an extended position. Specifically, and as shown in FIG. 11, the link 22 may be rotated to a position of use by rotating the link over at least one locking member 102 where it is secured in the extended position and ready to receive a fastener. In some embodiments, the locking members 102, 104 comprise resilient plastic members.

While various embodiments have been described in detail, it is apparent that modifications and alterations of those embodiments will occur to those skilled in the art. It is to be expressly understood that such modifications and alterations are within the scope and spirit of the present disclosure. Further, it is to be understood that the phraseology and terminology used herein is for the purposes of description and should not be regarded as limiting. The use of "including," "comprising," or "having" and variations thereof herein are meant to encompass the items listed thereafter and equivalents thereof, as well as, additional items.

What is claimed is:

1. An anchor assembly for securing a precast concrete panel to a structural component, the anchor assembly comprising:

an anchor member with a first end comprising a foot and a necked portion, a plate portion having a first end and second end, the first end of the plate portion extending from the foot, and wherein the first end of the anchor member is operable to be disposed within a volume of concrete;

a second end of the plate portion interconnected to a curved portion and an angled portion, wherein the angled portion is provided at an angle of less than ninety degrees relative to a plane that extends through the plate portion, and the angled portion comprises a deviation from the plate portion, and wherein the angled portion comprises an upper surface and a lower surface;

a projection welded to at least one of the upper surface and the lower surface;

a link member which is selectively rotatable and secured to the projection; and the link member comprising a first aperture for receiving the projection and a second aperture for receiving an elongate fastener.

2. The anchor assembly of claim 1, further comprising a void former having a cap, and wherein the void former is operable to receive the link member and allow selective access to the link member.

3. The anchor assembly of claim 1, further comprising a threaded bolt that is operable to be received through the second aperture of the link member.

4. The anchor assembly of claim 1, wherein the projection comprises a welded stud.

5. The anchor assembly of claim 1, wherein the projection comprises a pin.

6. The anchor assembly of claim 1, wherein the projection comprises an elongate member comprising a length of at least approximately one inch.

7. A precast concrete structural member with integral anchor assembly for securing structural components:

an anchor member having a first end and second end, the first end comprising a free end operable to be disposed within a volume of concrete;

an angled portion provided proximal to the second end, wherein the angled portion comprises an upper surface and a lower surface;

a projection provided on at least one of the upper surface and the lower surface;

a link member; and the link member comprising a first aperture for receiving the projection and a second aperture for receiving an elongate fastener, where the link member is operable to be selectively rotated between a first position wherein the link member is provided within a void in a wall panel and a second position wherein the link member extends from a void in a wall panel.

8. The anchor assembly of claim 7, further comprising a void former having a cap, and wherein the void former is operable to receive the link member and allow selective egress of the link member.

9. The anchor assembly of claim 7, further comprising a threaded bolt that is operable to be provided through the second aperture of the link member.

10. The anchor assembly of claim 7, wherein the projection comprises a welded stud.

11. The anchor assembly of claim 7, wherein the link is permanently and rotatably secured to the projection.

12. The anchor assembly of claim 7, wherein the projection comprises an elongate member comprising a length of at least approximately four inches.

13. A method of assembling a precast concrete panel to a structural member, the method comprising:

providing an anchor assembly having: a first end and second end, the first end comprising a free end operable to be disposed within a volume of concrete; an angled portion provided proximal to the second end, wherein the angled portion comprises an upper surface and a lower surface; a projection provided on at least one of the upper surface and the lower surface; and a link member that comprises a first aperture for receiving the projection and a second aperture for receiving an elongate fastener;

forming a precast concrete wall panel at least partially surrounding the anchor member;

positioning the precast concrete wall panel in a desired position proximal to a structural member;

rotating the link member from a first position within the precast wall panel to a second position wherein the link member extends outwardly from the precast concrete wall panel;

providing a fastener through the second aperture of the link member and through at least a portion of the structural member to secure the link member, the anchor, and the precast concrete wall panel to the structural member.

14. The method of claim 13, wherein the structural member comprises a foundation wall.

15. The method of claim 13, wherein the structural member comprises a concrete slab.

16. The method of claim 13, wherein the structural member comprises a ground material.

17. The method of claim 13, wherein the anchor assembly further comprises a void former with a selectively removable portion to allow for egress of the link member.

18. The method of claim 13, wherein the fastener comprises a threaded bolt.

19. The method of claim 13, wherein the step of forming the wall panel comprises pouring a concrete wall panel.

20. The method of claim 13, further comprising a step of forming a hole in the foundation member prior to providing the step of providing the fastener.

* * * * *